US008229312B2

(12) United States Patent
Shinyama

(10) Patent No.: US 8,229,312 B2
(45) Date of Patent: Jul. 24, 2012

(54) IMAGE FORMING DEVICE AND FUSER

(75) Inventor: Hideki Shinyama, Tokyo (JP)

(73) Assignee: Oki Data Corporation, Tokyo (JP)

( * ) Notice: Subject to any disclaimer, the term of this patent is extended or adjusted under 35 U.S.C. 154(b) by 234 days.

(21) Appl. No.: 12/588,322

(22) Filed: Oct. 13, 2009

(65) Prior Publication Data

US 2010/0104307 A1 Apr. 29, 2010

(30) Foreign Application Priority Data

Oct. 23, 2008 (JP) ..... 2008-273553

(51) Int. Cl.
*G03G 15/20* (2006.01)

(52) U.S. Cl. ..... 399/68
(58) Field of Classification Search ..... 399/68, 399/67
See application file for complete search history.

(56) References Cited

FOREIGN PATENT DOCUMENTS

| | | | |
|---|---|---|---|
| JP | 11038802 A | * | 2/1999 |
| JP | 11133802 A | * | 5/1999 |
| JP | 2005062700 A | * | 3/2005 |
| JP | A-2007-033618 | | 2/2007 |

* cited by examiner

*Primary Examiner* — David Gray
*Assistant Examiner* — Erika J Villaluna
(74) *Attorney, Agent, or Firm* — Posz Law Group, PLC

(57) ABSTRACT

An image forming device includes a heater, a heat application rotation member heated by the heater, a pressure application rotation member heated by the heat application rotation member, a detector configured to detect a surface temperature of the pressure application rotation member, and a controller configured to control a rotation speed of the heat application rotation member and a rotation speed of the pressure application rotation member. The controller varies at least one of the rotation speeds depending on an amount of temperature change or temperature change ratio detected by the detector until the surface temperature of the pressure application rotation member detected by the detector reaches a predetermined temperature.

8 Claims, 11 Drawing Sheets

| Temp. Increase Value ($\Delta T$) of Pressure Application Roller | Fusing Speed (mm/s) |
|---|---|
| $\Delta T < 50$ | 160 |
| $50 \leqq \Delta T < 55$ | 155 |
| $55 \leqq \Delta T < 60$ | 150 |
| $60 \leqq \Delta T < 65$ | 145 |
| $65 \leqq \Delta T$ | 140 |

Fig. 6

IMAGE FORMING DEVICE AND FUSER

CROSS REFERENCE TO RELATED APPLICATION

The present application is related to, claims priority from and incorporates by reference Japanese patent application No. 2008-273553, filed on Oct. 23, 2008.

TECHNICAL FIELD

The present invention relates to an image forming device and a fuser in which a heat application rotating member and a pressure application rotating member contact each other.

DESCRIPTION OF RELATED ART

A conventional image forming device, such as a printer or a copy machine, that uses an electrographic method typically includes an image forming device that contains a fuser equipped with a heat application roller to fuse a toner image on a sheet. Normally, at the fuser, a sheet on which a toner image is attached is inserted between the heat application roller that contains a heater inside and a pressure application roller that contacts the heat application roller; hence the toner is adhered (or fused) to the sheet by heat and pressure.

With this kind of fuser, the surface temperatures of the heat application roller that contains a heater and the pressure application roller that does not contain a heater most likely differ. In order to prevent the occurrence of a temperature difference, before performing the fusing operation, a method such as contacting and rotating both rollers without having a sheet sandwiched between the rollers has been used to decrease the temperature difference. Also, the surface temperature of the pressure application roller has been equalized using a pad. See Japanese laid-open patent application publication No. 2007-033618.

However, the method disclosed in the above reference does not factor in the frequency and increase of overshoot of a surface temperature of the pressure or heat application roller caused by such as heat capacity changes before and after inserting a sheet which is a medium. Because of this, the time for the surface temperature to stabilize to the target temperature fluctuates significantly. Moreover, due to the heat capacity of the pressure application roller, the frequency of the overshoot varies depending on a position of a temperature sensor that measures the surface temperature of the pressure application roller.

An object of the present invention is to solve the aforementioned problems, and to provide an image forming device that can decrease the overshoot of the surface temperature of the pressure application roller.

SUMMARY

In order to realize the object, an image forming device of the present invention includes a heater, a heat application rotation member heated by the heater, a pressure application rotation member heated by the heat application rotation member, a detector configured to detect a surface temperature of the pressure application rotation member, and a controller configured to control a rotation speed of the heat application rotation member and a rotation speed of the pressure application rotation member. The controller varies at least one of the rotation speeds depending on an amount of temperature change or temperature change ratio detected by the detector until the surface temperature of the pressure application rotation member detected by the detector reaches a predetermined temperature.

Accordingly, even when the surface temperature of the pressure application roller changes depending on the heat capacity fluctuation due to, for example, insertion of a medium (for example, a sheet), and overshoot occurs, the temperature changes can be controlled by fluctuating the rotation speed when the amount of change or change ratio of the surface temperature is larger than a predetermined value. Therefore, the time required to make the surface temperature of the pressure application roller become constant can be shortened. At this time, stabilization time for equalizing the surface temperature distribution of the pressure application roller contact surface can be also shortened by using the pad. Moreover, a detector to detect the surface temperature is positioned apart from a contacting position of the heat application roller and pressure application roller. Therefore the frequency of overshoot caused by the heat capacity of the pressure application roller can be decreased.

Further, it is preferred that the amount of temperature change of the surface temperature that is detected by the detector is calculated by the controller based on a temperature increase value that is measured at a predetermined time after the heater begins to heat the heat application rotation member. Also, the image forming device of the present invention is preferably configured to increase the rotation speed above a standard rotation speed when the amount of temperature change or temperature change ratio of the surface temperature detected by the detector is smaller than the predetermined temperature, to set the rotation speed to the standard rotation speed when the amount of temperature change or temperature change ratio of the surface temperature detected by the detector equals the predetermined temperature, and to decrease the rotation speed below the standard rotation speed when the amount of temperature change or temperature change ratio of the surface temperature detected by the detector is greater than the predetermined temperature.

Moreover, it is preferred that the temperature change ratio of the surface temperature detected by the detector is calculated by the controller based on the temperature increase value that is measured at a predetermined interval after the heater begins to heat the heat application rotation member.

According to the present invention, the overshoot of the surface temperature of the pressure application roller can be decreased. Accordingly, unequal surface temperature distribution of the heat application roller and the pressure application roller at the time of heating can be prevented, and the time required for the surface temperature to become constant can be shortened.

BRIEF DESCRIPTION OF DRAWINGS

FIG. 6 is a table showing a condition of a temperature increase and fusing speed of the pressure application roller of the fuser in the first embodiment.

DETAILED DESCRIPTION

A detailed description of various embodiments of the image forming device according to the present application with reference to the drawings follows. Moreover, these drawings are described schematically to the extent necessary to understand the present invention. However, values and other conditions according to the present application are merely preferred examples and are not limited to the description below, as wide variety of alterations and modifications are possible as long as they do not depart from the spirit and scope of the attached claims. Moreover, hatching or the like is omitted in the cross sectional diagrams in order to minimize drawing complexity.

First Embodiment

An explanation of an image forming device according to a first embodiment is given below with reference to FIGS. 1-7.

Figure 1:
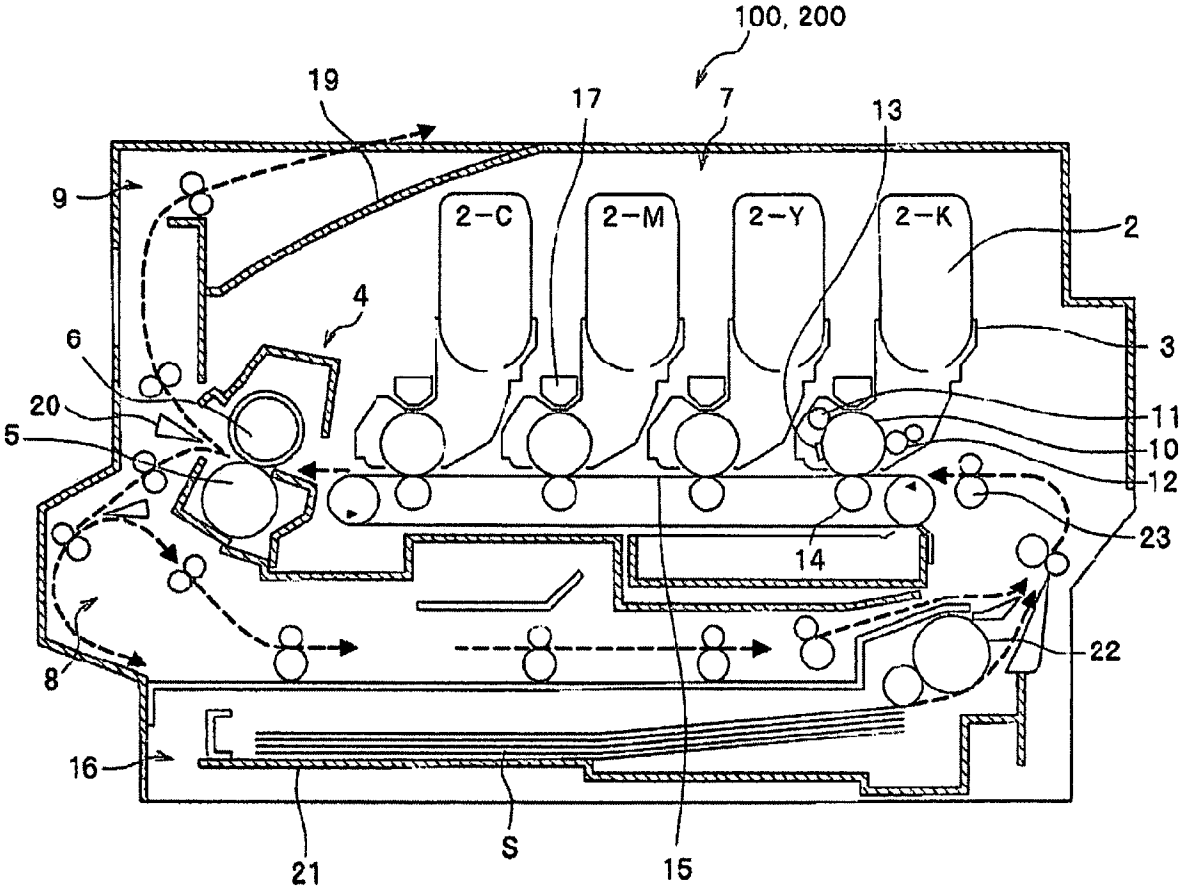
FIG. 1 is a cross sectional view showing an image forming device to explain an embodiment of the present invention.
Figure 2:
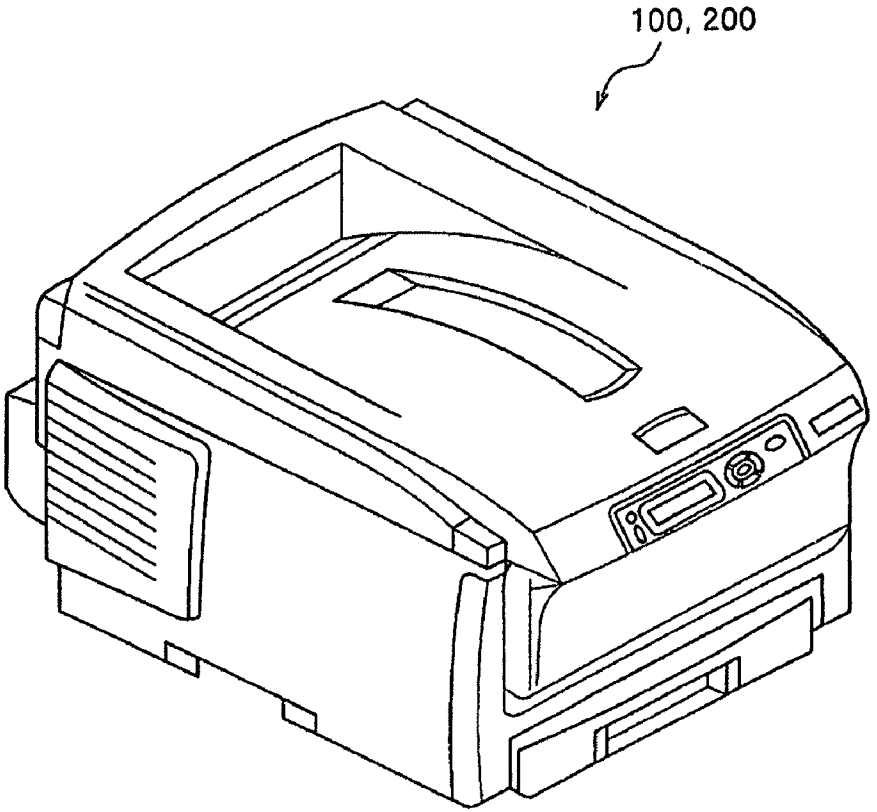
FIG. 2 is a schematic perspective view of the image forming device of FIG. 1.

FIG. 1 is a cross sectional view of an image processing device of the first embodiment. A tandem system printer device is used, for example. Moreover, FIG. 2 is a schematic perspective view of the image forming device 100.

As shown in FIG. 1, the image forming device 100 includes a sheet feeding part 16, an image forming part 7, a fuser 4, a double-sided printing unit 8, an ejecting unit 9 and an ejecting tray (cover) 19, and has a structure to form images on a recording sheet S.

(Structure) The structure of the image forming device 100 is explained along with a flow of printing operation. First of all, a sheet feeding part 16 transfers the recording sheet S. The sheet feeding part 16 includes a sheet feeding cassette 21, a sheet feeding roller 22, a resist roller 23 or the like. The recording sheet S that is carried from the sheet feeding cassette 21 by rotation of the sheet feeding roller 22 is sent to the resist roller 23, and further is sent along with a transfer carrying belt 15, and reaches the image forming part 7.

The image forming part 7 is equipped with four image forming units 3 that respectively include different colors (total four colors). Furthermore, the four image forming units 3 are aligned in order. FIG. 1 illustrates the alignment in which black (K), yellow (Y), magenta (M) and cyan (C) are arranged from right to left. Moreover, toner cartridges 2-K, 2-Y, 2-M and 2-C are equipped with each image forming unit 3 corresponding to its color.

Further, the image forming units 3 and the toner cartridges 2-K, 2-Y, 2-M and 2-C are separable. The four kinds of toner cartridges 2-K, 2-Y, 2-M and 2-C have an identical structure except for the color of the stored developing agent. Moreover, the image forming part 7 has a structure such that the image forming units 3 and printing heads 17 contact each other when the cover 19 closes.

Each image forming unit 3 includes a photoreceptor drum 10, a charger 11, a developing roller 12 and a cleaner 13. The surrounding of the photoreceptor drum 10 is formed from photo-conductive material, and the charger 11, the developing roller 12 and the cleaner 13 are arranged respectively near the photoreceptor drum 10. Moreover, a transferring device 14 is impressed to the photoreceptor drum 10 in which the transfer carrying belt 15 is disposed therebetween.

The photoreceptor drum 10 rotates in a sheet transferring direction and its surface is uniformly electronically charged by electrons provided from the charger 11. The printing head 17 forms an electrostatic latent image on a surface of the photoreceptor drum 10 by exposures (or optical writing processes) based on printing information. Then, the developing roller 12 forms a toner image on a top surface of the recording sheet S by performing developing processing. At this time, the toner image that is formed on each surface of the photoreceptor drum 10 is formed with the each color toner that is stored in the respective toner cartridge 2. Accordingly, the toner image formed on the surface of the photoreceptor drum 10 reaches a position of the transferring device 14 in accordance with rotation of the photoreceptor drum 10, and is transferred on the top surface of the recording sheet S that moves beneath the photoreceptor drums 10 as indicated by the directional arrows, and the printing process is performed.

Next, the recording sheet S to which the toner image is transferred at each image forming unit 3 moves as indicated by the directional arrows on the transfer carrying belt 15 along with the movement of the transfer carrying belt 15, and heat fusing process is performed at the fuser 4.

While the recording sheet S is sandwiched and carried between a heat application roller 6 and a pressure application unit 5 of the fuser 4, the toner images of the several colors that are transferred on the top side of the recording sheet S are fused, then fixed on the recording sheet S. The recording sheet S on which the toner image is fused by the fuser 4 is either carried to the ejecting unit 9, then ejected to the ejecting tray 19, or carried to the double-sided printing unit 8 through a switching plate 20 when double-sided printing needs to be performed, and image forming on the back side of the recording sheet S is performed again at the image forming part 7.

Figure 3:
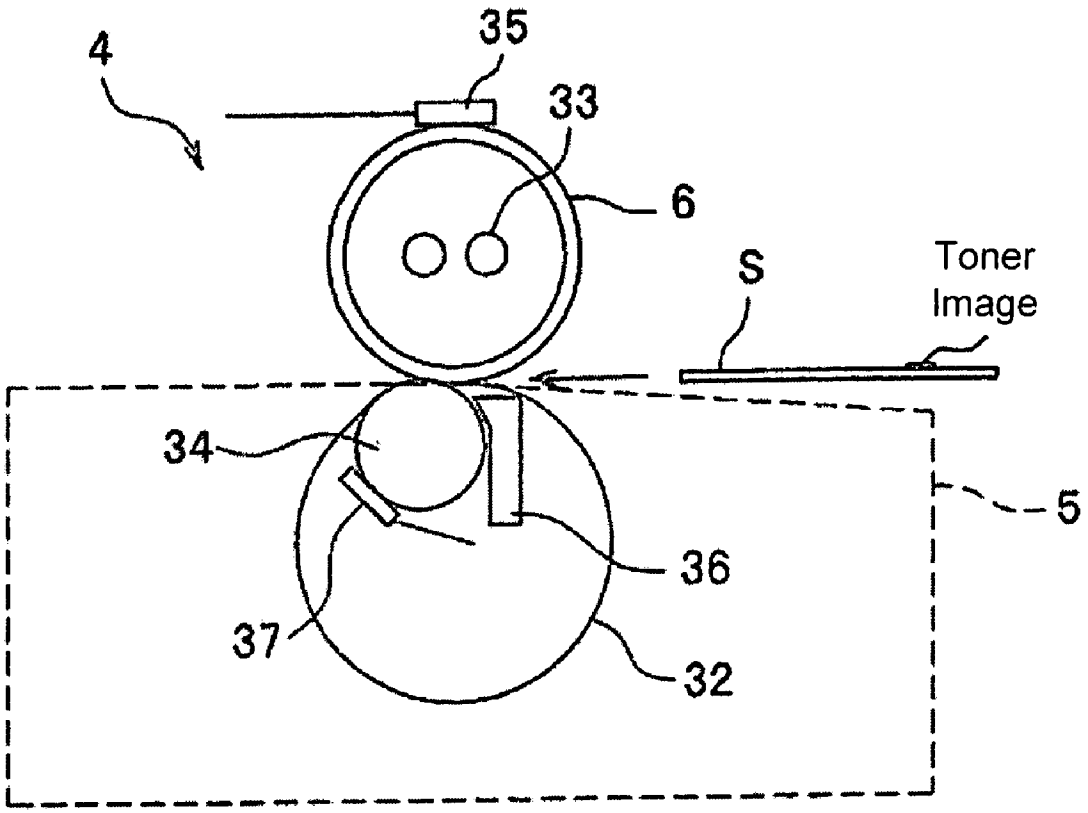
FIG. 3 is a cross sectional view of a structure of the fuser of the image forming device.

FIG. 3 is a cross sectional pattern diagram showing a structure of the fuser 4. The fuser 4 includes the pressure application unit 5 which includes a heat application roller 6 as a heat application rotation member and a pressure application roller 34 as a pressure application rotation member.

Two cylinder shaped heaters 33 are disposed inside of the heat application roller 6 as heaters. The top part of the heat application roller 6 includes a temperature sensor 35. The temperature sensor 35 detects the top surface temperature of the heat application roller 6.

Moreover, the pressure application unit 5 is configured with a pressure application belt 32, a pressure application roller 34, a pad 36 and a temperature sensor 37 as a detector for detecting the surface temperature of the pressure application roller 34. The pressure application belt 32 surrounds the pressure application roller 34 and the pad 36 and rotates along with the rotation of the pressure application roller 34. The temperature sensor 37 detects the bottom surface temperature of the pressure application roller 34 as a surface temperature of the pressure application rotating member.

Accordingly, in the fuser 4 of the present embodiment, the heat application roller 6 and the peripheral side of the pressure application belt 32, which has its back side pressured by the pressure application roller 34 and the pad 36, press the recording sheet S from both sides. The portion of the pressure application belt 32, which contacts (or that is biased against) the heat application roller 6 is defined as a nip part (or contacting part).

The pad 36 is disposed so as to increase a nip length of the pressure application belt 32 with respect to a rotating direction of the belt 32 by pressuring the pressure application belt 32 from its back side together with the pressure application roller 34. Accordingly, material of the pad 36 is heat resistant, heat insulated, has adequate rigidity, and does not cause heat deformation. An example of a material that can be used for the pad 36 is a rigid metal (for example, steel). For the pressure application belt 32, a cloth that has heat insulation and heat resistance properties, and that that is coated with fluorine contained resin on its surface, may be used. Example of such a cloth includes woven glass fiber cloth and aramid fiber clothe.

Figure 4:
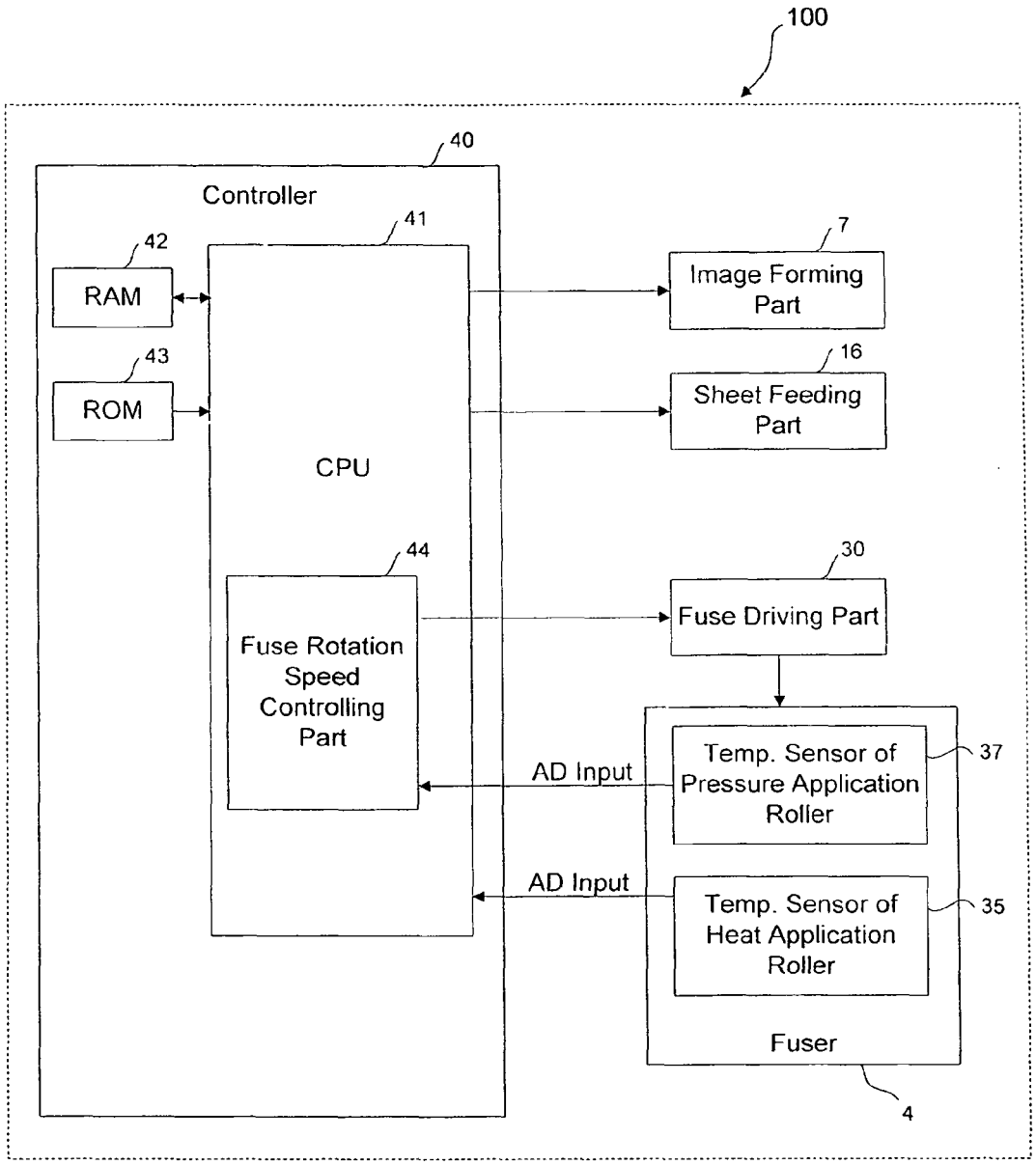
FIG. 4 is a block diagram showing a control structure of the image forming device in a first embodiment.

Next, the control structure of the image forming device 100 is explained in detail with reference to FIG. 4. FIG. 4 is a block diagram showing a control structure of the image forming device 100. In the image forming device 100, the controller 40 is a central processing unit (CPU) 41 that includes a fuse rotation speed controlling part 44 or the like, a random-access memory (RAM) 42 and a read-only memory (ROM) 43 as a main control structure. Moreover, the controller 40 is electronically connected to the image forming device 7, the sheet feeding part 16 and the fuser 4, as well as to the fuse driving part 30 that drives the fuser 4. Also, temperature information sent from the temperature sensor 35 of the heat application roller 6 and the temperature sensor 37 of the pressure application roller 34 that are the structure elements of the fuser 4 are input into analog digital converting input terminals (AD input terminals) of the CPU 41. Particularly, the temperature sensor 37 of the pressure application roller 34 is connected to an AD input terminal of the fuse rotation speed controlling part 44 of the CPU 41.

At this point, programs with respect to image forming operations are stored at the image forming part 7 in the ROM 43. The CPU 41 reads necessary programs from the ROM 43 and uniformly controls the operations of the image forming part 7, the sheet feeding part 16 and the fuser 4, and executes the image forming operations. The RAM 42 is used as a work area when the CPU 41 executes the control programs.

Moreover, the controller 40 executes the image forming operations, receives a detection signal from the temperature sensor 35, and controls power supply amount to the heater 33 in order to maintain the temperature of the heat application roller 6 to the predetermined fusing temperature by monitoring the temperature of the heat application roller 6.

As will be later described, the controller 40 receives a detection signal from the temperature sensor 35 and further determines the rotation speeds of the heat application roller 6 and the pressure application roller 34 according to the received information and the data stored in the fuse rotating speed controlling part 44.

(Operation) The operation of the fuser 4 will now be explained. When the power of the image forming device 100 is turned on, a so-called warm-up operation is executed. During the warm-up operation, the heat application roller 6 and the pressure application roller 34 of the pressure application unit 5 are rotary-driven by the fuse driving part 30. The temperature of the heat application roller 6 is raised to 190° C., which is a fusing temperature, by the heater 33. The temperature of the pressure application roller 34, during rotation, is raised to 120° C. by heat transmission from the heat application roller 6.

When the image forming device 100 receives a print job in the condition, the image forming operations are executed. During the image forming operations, a toner image is formed at the image forming part 7, then the toner image is transferred to the recording sheet S. The recording sheet S to which the toner image (non-fused image) is transferred is carried with being sandwiched to the contacting part of the heat application roller 6 and the pressure application unit 5. In other words, the recording sheet S is carried to the nip part. Next, the toner image is fused by heat and pressure, and the recording sheet S is ejected on the ejecting tray 19 through the ejecting unit 9.

After the image forming operations are completed, the image forming device 100 goes into a waiting mode until receiving the next job. In the waiting mode, rotations of the heat application roller 6 and the pressure application roller 34 of the fuser 4 are suspended. The heat application roller 6 is controlled so as to maintain the fusing temperature (190° C. in the present invention) by heating using the heater 33. On the other hand, since the pressure application roller 34 has a structure to receive the heat from the heat application roller 6 through the pressure application belt 32 by rotating as mentioned above, and to maintain the predetermined temperature (120° C. in the present invention), heat transmission from the heat application roller 6 to the pressure application roller 34 decreases in the waiting mode in which the rotation is suspended. As a result, the surface temperature of the pressure application roller 34 that is sensed by the temperature sensor 37 gradually decreases.

Next, the operations of the image forming device 100 upon receiving a new job after being in a waiting mode are explained with reference to FIGS. 5A and 5B.

Figure 5A:
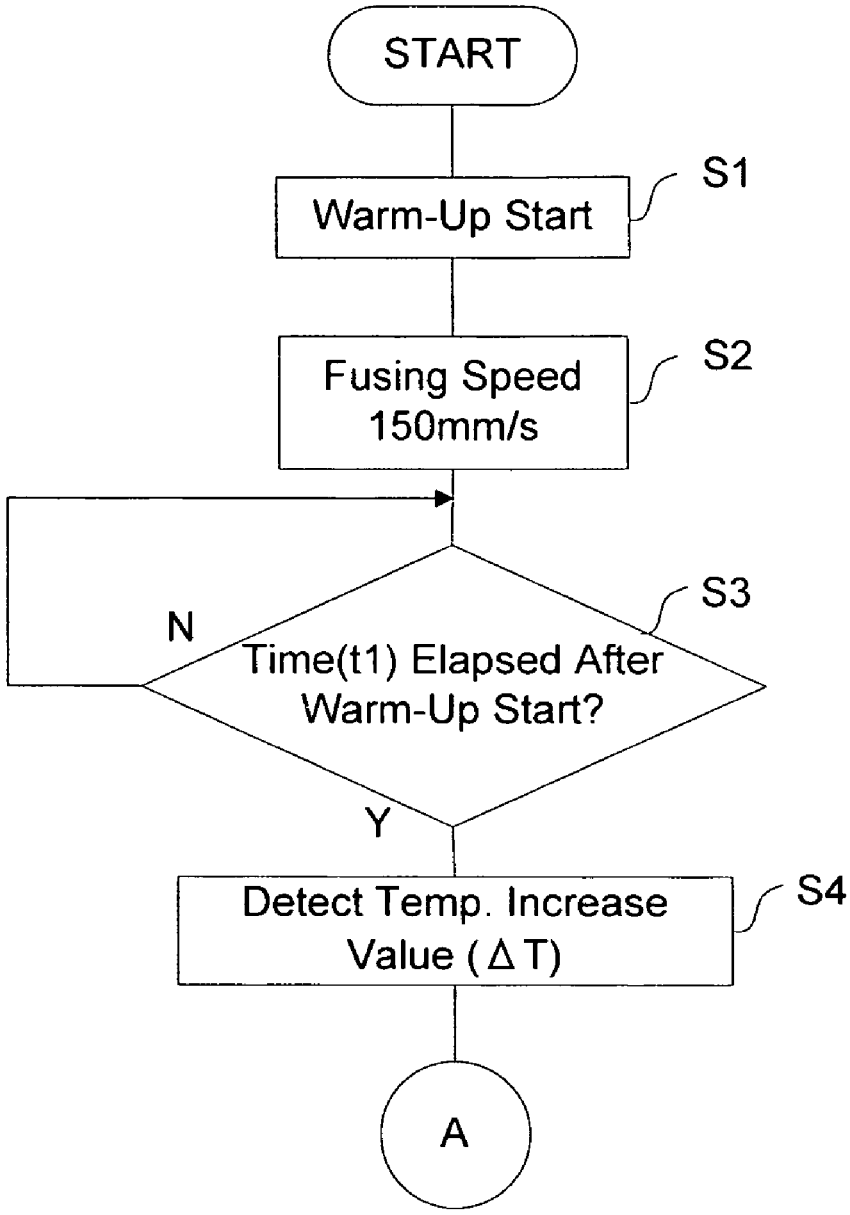
FIG. 5A is a flow diagram showing a first half of a control flow of the fuser when the image forming device of the first embodiment that was in the waiting mode starts image forming operation.
Figure 5B:
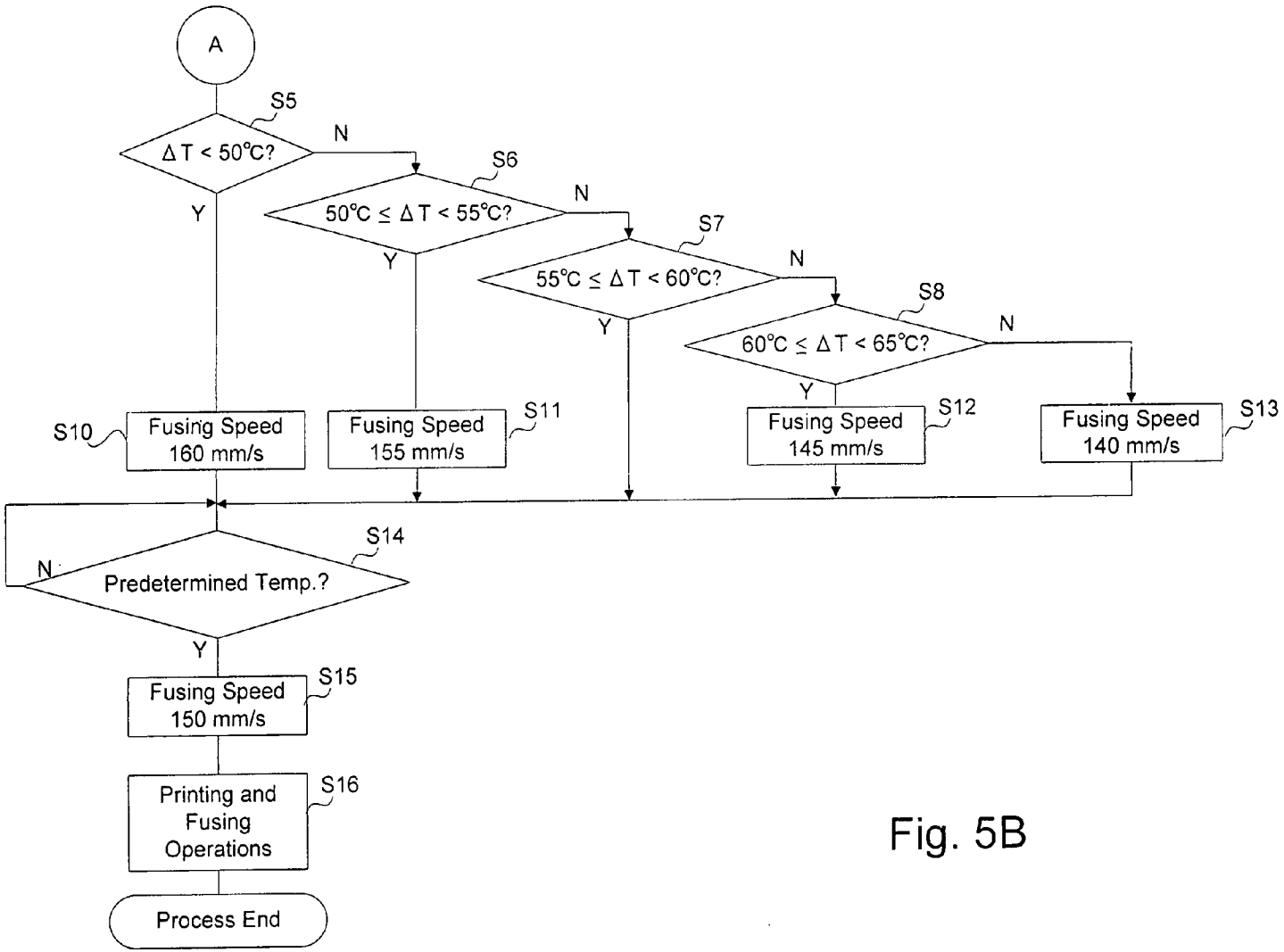
FIG. 5B is a flow diagram showing a second half of a control flow of the fuser when the image forming device of the first embodiment starts image forming operation.

FIGS. 5A and 5B are flow diagrams showing the control of the fuser 4 when the image forming device in the waiting mode starts image forming operation.

Initially, as shown in FIG. 5A, when the image forming device 100 shifts to the image forming operations (or operation mode) from the waiting mode, the warm-up processing starts as shown at S1, performs heat processing of the heater 33, then starts rotation processing of the fuser 4 at S2. The fuser 4 at this point rotates the heat application roller 6 and the pressure application roller 34 at a fusing speed of 150 mm/s that is equivalent to the fusing rotation speed at the time of printing. This fusing speed of 150 mm/s, which is equivalent to the fusing rotation speed at the time of printing, is the standard speed.

Next S3 is a process to monitor whether the constant time t1 has elapsed after the warm-up started, and judges whether or not the constant time t1 has elapsed after the warm-up started. When the constant time t1 has elapsed (YES), processing proceeds to S4. When the constant time t1 has not elapsed, processing returns to S3 and continue the process until the constant time t1 is elapsed.

At S4, the surface temperature of the pressure application roller 34 after the constant time t1 has elapsed is detected by the temperature sensor 37 and the temperature increase value $\Delta T$ is detected.

Next, as shown in FIG. 5B, processing from S5 to S8 proceeds to S10 from S13 respectively, depending on the detected temperature increase value $\Delta T$, and the fusing speed of the heat application roller 6 and the pressure application roller 34 is determined.

In other words, at S5, processing determines whether or not the temperature increase value ΔT is less than 50° C. When it is less than 50° C. (YES), processing proceeds to S10, the fusing speed is set to 160 mm/s which is faster than the standard speed and printing speed of 150 mm/s. When the temperature increase value ΔT is more than 50° C., processing proceeds to S6.

At S6, processing judges whether or not temperature increase value ΔT is equal to or more than 50° C. and less than 55° C. When the result matches with the condition (YES), processing proceeds to S11, and the fusing speed is set to 155 mm/s which is faster than the printing speed but slower than the fusing speed set at S10. When the condition does not match (NO) at S6, processing proceeds to S7.

At S7, processing judges whether or not the temperature increase value ΔT is equal to or more than 55° C. and less than 60° C. When the result matches with the condition (YES), processing proceeds to S14, and the fusing speed is set to 150 mm/s that is a standard speed. When the condition does not match (NO) at S7, processing proceeds to S8.

At S8, processing judges whether or not the temperature increase value ΔT is equal to or more than 60° C. and less than 65° C. When the result matches with the condition (YES), processing proceeds to S12, and the fusing speed is set to 145 mm/s. When the condition does not match (NO) at S8, processing proceeds to S13, and the fusing speed is set to 140 mm/s.

Thus, the processing from S5 to S8 and the fusing speed changes from S10 to S13 determine the fusing speed with the conditions shown in FIG. 6. Executing this processing at the fuser 4 is a characteristic of the present embodiment.

In short, when the temperature increase value ΔT of the pressure application roller 34 after the constant time t1 has elapsed after the start of warm-up is equal to or more than 55° C. and less than 60° C., which is the temperature increase of the standard value, the fusing speed does not change from 150 mm/s, which is same speed as the printing speed. However, when the temperature increase value ΔT is smaller, that is, equal to or more than 50° C. and less than 55° C., the fusing speed is changed to 155 mm/s which is faster than the printing speed. Moreover, when the temperature increase value ΔT is less than 50° C., the fusing speed is increased to 160 mm/s. On the contrary, when the temperature increase value ΔT is larger than the temperature increase of the standard value and when the detected temperature is equal to or more than 60° C. and less than 65° C., the fusing speed is set to 145 mm/s, which is slower than the printing speed. Moreover, when the temperature increase value ΔT is equal to or more than 65° C., the fusing speed is decreased to 140 mm/s.

Next, when the processing from S5 to S8 and the fusing speed change processing from S10 to S13 is completed, processing proceeds to S14. At S14, processing continues until both of the heat application roller 6 and the pressure application roller 34 reach the predetermined temperature, and when the predetermined temperature is detected (YES), processing proceeds to S15, and processing to return the fusing speed to the standard value of the printing speed of 150 mm/s performed. At this point, preparation of fusing is completed, and printing and fusing operations are performed at S16.

Figure 7A:
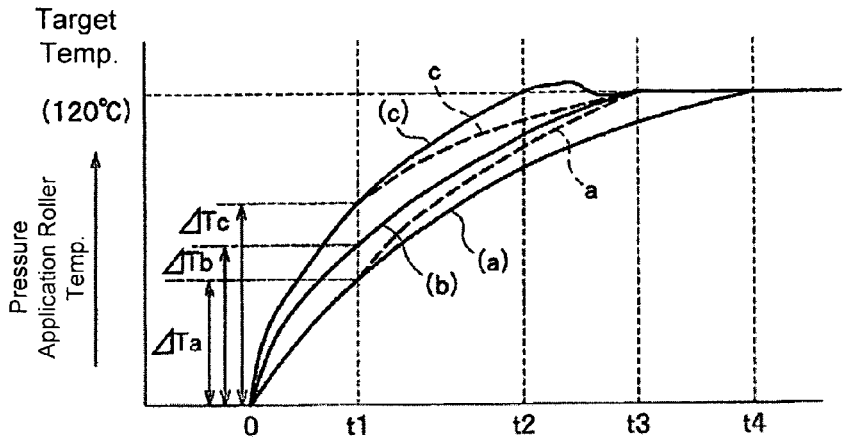
FIG. 7A is a time chart showing temperature change of the pressure application roller of the fuser in the first embodiment.
Figure 7B:
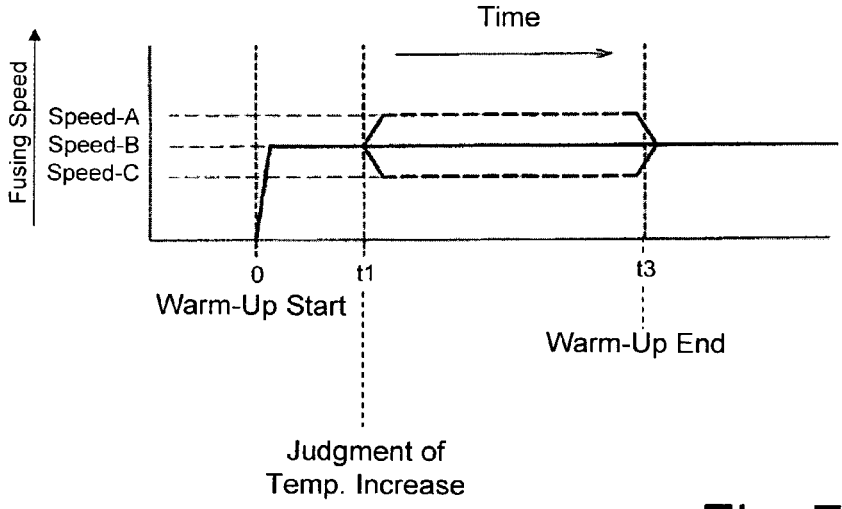
FIG. 7B is a time chart showing a control of the fusing speed of the fuser in the first embodiment.

FIGS. 7A and 7B are time charts showing the temperature change of the pressure application roller 34 versus time and the control processing of the fusing speed versus time, respectively. A horizontal axis of FIGS. 7A and 7B shows the elapsed time since the warm-up started. The vertical axis of FIG. 7A shows changes of the temperature increase value ΔT of the pressure application roller 34, while the vertical axis of FIG. 7B shows the changes of the fusing speed controlled with respect to the temperature increase value ΔT of the pressure application roller 34.

As shown in FIGS. 7A and 7B, when judging of the temperature increase after time t1 has elapsed since the warm-up started, when the temperature increase value ΔT of the pressure application roller 34 is equal to ΔTb, which is the standard temperature increase value, the fusing speed is not changed and continues the warm-up processing with Speed-B of the fusing speed without changing the fusing speed. When the temperature increase value ΔT of the pressure application roller 34 is smaller than the standard value, ΔTa, in order to increase the amount of heat transmission, the fusing speed is changed to speed a, which is faster than the standard value. Moreover, when the temperature increase value ΔT of the pressure application roller 34 is larger, ΔTc, the fusing speed is changed to Speed-C, which is slower than the printing speed, in order to decrease the heat transmission amount to the pressure application roller 34 from the heat application roller 6.

When this kind of control is not performed, as shown in solid lines of (a), (b) and (c) of FIG. 7A, when the temperature of the pressure application roller 34 in the case of when the fusing speed is not changed is the standard value, the temperature increases as shown at the solid line (b), which is located in the middle of the figure. At t3, the temperature of the pressure application roller 34 reaches the target temperature of 120° C., which is the predetermined temperature. Moreover, in this case, the heat transmission amount to the pressure application roller 34 from the heat application roller 6 is not controlled because the fusing speed is not changed. Therefore, at ΔTc, when the temperature increase is large, as shown at the solid line (c), an overshoot phenomenon occurs in which the temperature of the pressure application roller 34 increases more than the target temperature until t3, which is the time when the warm-up is completed. Moreover, in the case of ΔTa, when the temperature increase is smaller than the standard value ΔTb, as shown at the solid line (a), the temperature has not been raised to the target temperature at t3, which is the standard warm-up completion time. Therefore, the actual warm-up completion is delayed until t4.

On the contrary, when the control described in the present embodiment is performed, the temperature increase changes as shown at broken lines a and b in FIG. 7B because it becomes possible to ideally maintain the heat transmission amount to the pressure application roller 34 from the heat application roller 6 when the fusing speed is changed as shown in FIG. 7B according to the temperature increase of the pressure application roller 34 at t1. Accordingly, at t3 until the warm-up is completed, the overshoot phenomenon at the solid line (c) does not occur, and the phenomenon in which the temperature of the solid line (a) does not fully increase at t3 does not occur.

As explained above, in the first embodiment, during warm-up processing for shifting the condition from the waiting mode to the image forming operation mode, the fusing speed is changed based on the temperature of the pressure application roller 34. By doing this action, time necessary for homogenizing the surface temperature of the pressure application roller 34 after the target fusing temperature is reached can be stabilized without being largely influenced by the temperature difference of the heat application roller 6 and the pressure application roller 34, or the heat retaining condition inside of the pressure application roller 34. Moreover, the warm-up time is shortened because the pressure application roller 34 can be adequately heated. In other words, the settling time is also can be reduced by reducing the amount of the overshoot or undershoot with respect to the target fusing temperature.

Second Embodiment

The second embodiment of the image forming device of the present invention is explained with reference to FIGS. 8 and 10. Moreover, to explain an image processing device 200 of the present embodiment, the same numbers are used for the same structural elements as in the image forming device 100.

Figure 8:
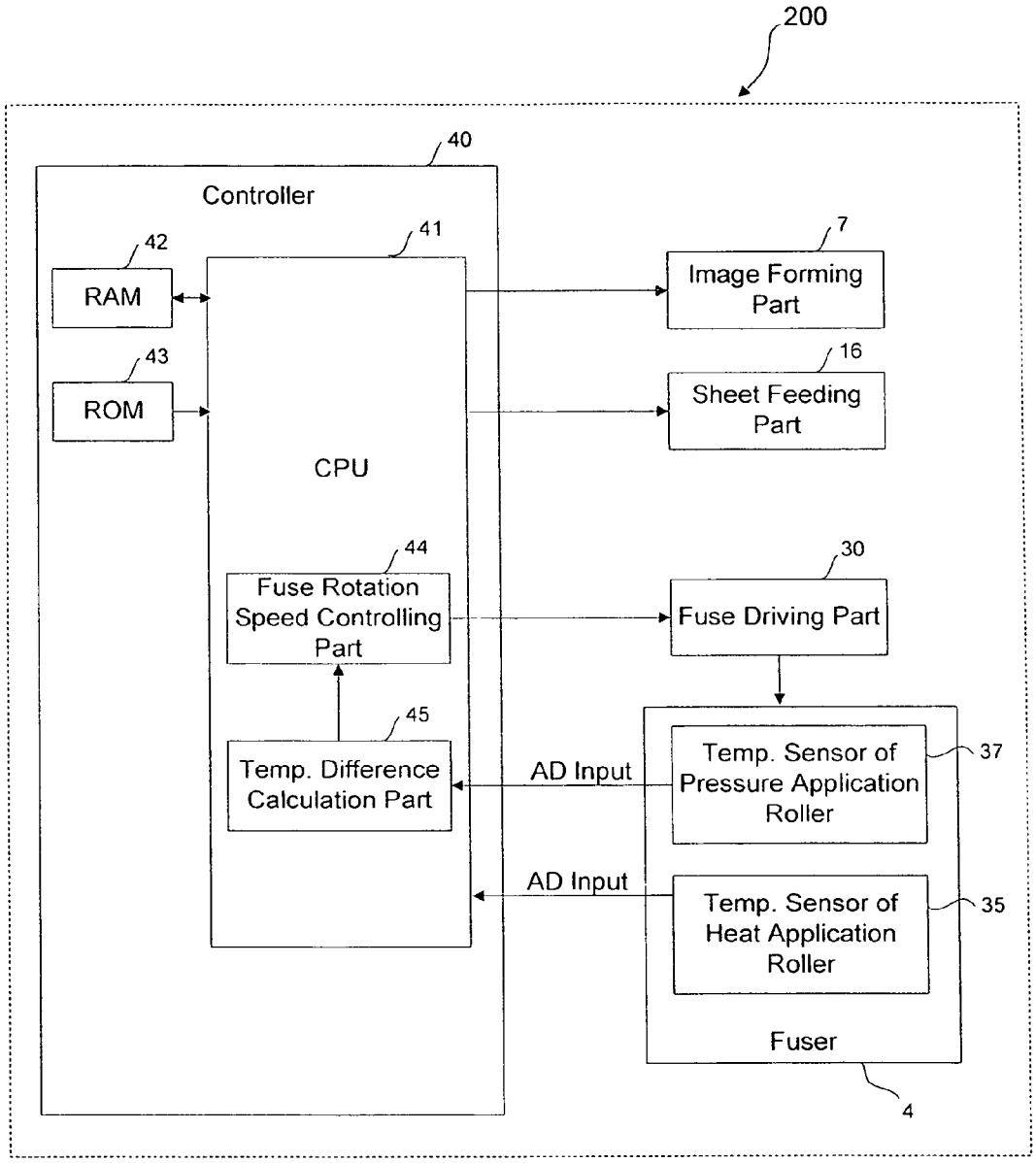
FIG. 8 is a block diagram showing a control structure of an image forming device in a second embodiment.

(Structure) Referring to FIG. 8, the control structure of the image forming device 200 of the second embodiment is explained. FIG. 8 is a block diagram showing the control structure of the image forming device 200.

As for the structural elements, a temperature difference calculation part 45 is added as a structural element of the CPU 41 of the controller 40 in the image forming device 100 of the first embodiment. To this temperature difference calculation part 45, the detected temperature is input from the temperature sensor 37 of the pressure application roller 34. The temperature difference calculation part 45 performs a temperature comparison after a predetermined interval to calculate the difference between the standard temperature increase and the actual temperature increase of the pressure application roller 34, and inputs the successive temperature comparison information in the fuse rotation speed controlling part 44.

Figure 9:
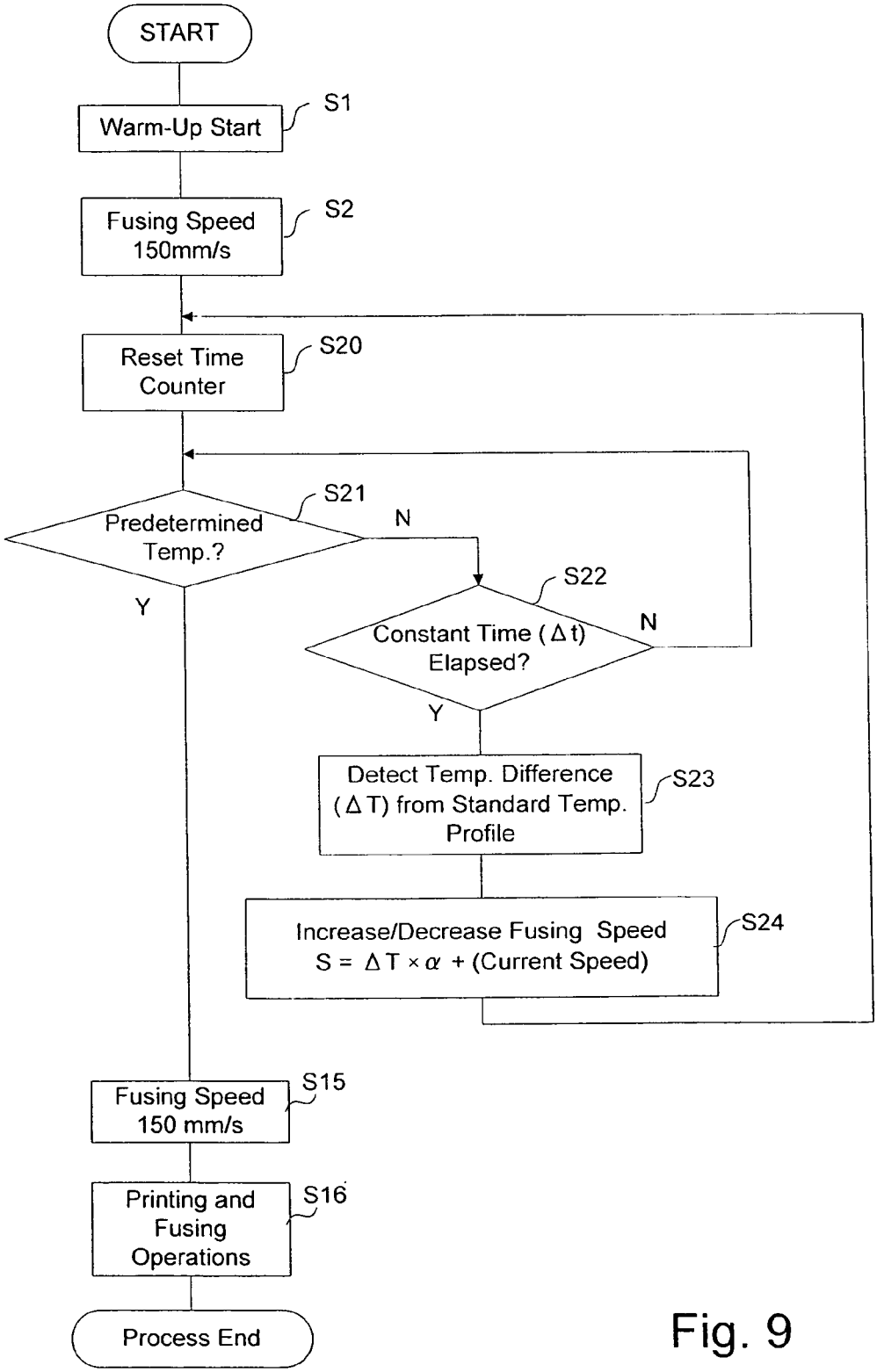
FIG. 9 is a flow diagram showing a control flow of the fuser when the image forming device of the second embodiment that was in the waiting mode starts image forming operation.

(Operation) FIG. 9 is a flow diagram showing control of a fuser 4 when the image forming device 200 that is in a waiting mode starts the image forming operation.

The processing from S1 to S2 is the same as the first embodiment. Initially, when the image forming device 200 shifts to the image forming operation mode from the waiting mode, warm-up processing is started at S1, heat processing of a heater 33 is performed, and rotation processing of the fuser 4 is started at S2. At this point, the fusing speed of the fuser 4 is 150 mm/s, which is the same as a fusing speed at the printing operation.

Next, at S20, the time counter is reset in order to monitor the temperature increase of the pressure application roller 34 at a constant interval.

After the time counter is reset at S20, a judgment of whether or not the fuser 4 reached the temperature at which fusing is possible (predetermined temperature) is performed at S21. At this point, if the temperature does not reach the predetermined temperature (NO), processing proceeds to S22, and judges the elapsed time of the time counter.

At S22, processing judges whether or not the constant time Δt has elapsed at the time counter. When the constant time has elapsed, processing proceeds to S23. However, when the constant time has not elapsed (NO), processing returns to S21.

At S23, the temperature difference ΔT of the temperature increase value and the standard temperature increase value (standard temperature profile) of the pressure application roller 34 is detected, and processing proceeds to S24. The fusing speed of the fuser 4 is changed from the temperature difference of ΔT according to the formula 1 below;

$$S=\Delta T\times\alpha+(\text{Current Speed}) \quad \text{(formula 1)}$$

where α is a constant number.

Due to the processing at S24, when the temperature increase is lower than the standard temperature increase, the fusing speed of the fuser 4 is increased, and when the temperature increase is higher than the standard temperature increase, the fusing speed of the fuser 4 is decreased. Processing then returns to S20, and the time counter is reset.

While repeating the above described processing, when processing judges that the temperature has reached the fusing capable temperature (or the predetermined temperature) at S21, processing proceeds to S15, and performs the processing to return the fusing speed of the fuser 4 to the printing speed of 150 mm/s. At this point, preparation for fusing is completed, and the printing and fusing processing are performed at S16.

Figure 10A:
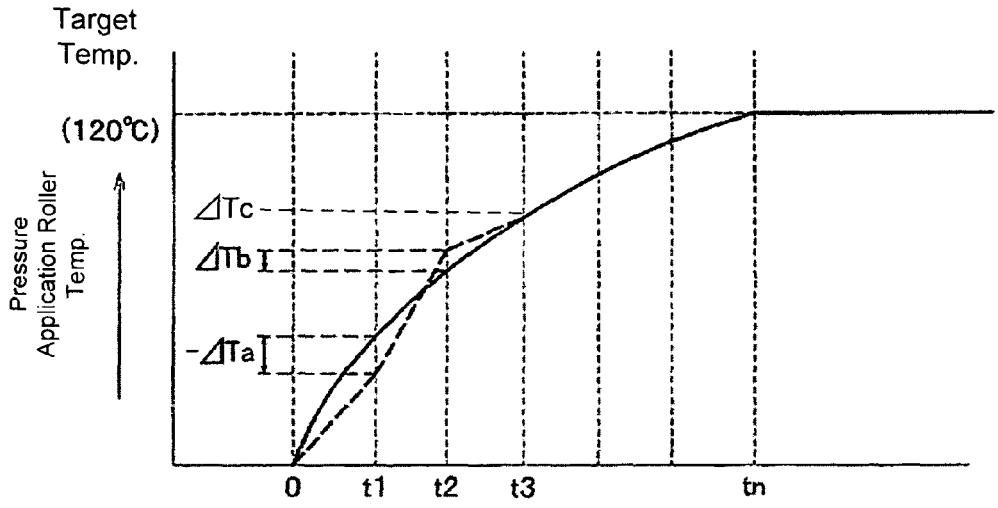
FIG. 10A is a time chart showing a control of temperature change of the pressure application roller of the fuser in the second embodiment.
Figure 10B:
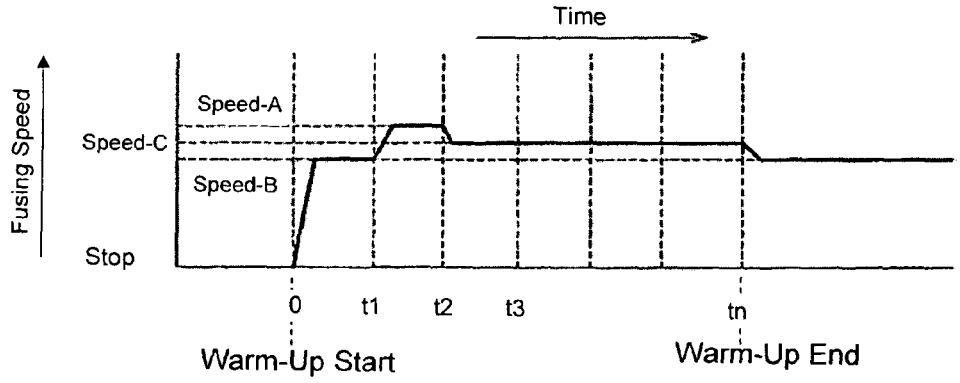
FIG. 10B is a time chart showing a control of the fusing speed of the fuser in the second embodiment.

FIGS. 10A and 10B are time charts showing elapsed time of the repeated above-described processing on the horizontal axis, and the temperature change of the pressure application roller 34 and an example of fusing speed changes of the fuser 4 on the vertical axis.

As shown in FIGS. 10A and 10B, in the present embodiment, the aforementioned temperature difference −ΔTa exists at t1, which is the first constant time that elapses after the warm-up begins. Applied to the aforementioned formula 1, the fusing speed is changed to Speed-A, which is faster than printing speed (Speed-B). By performing this action, as the ratio of heat transmission amount to the pressure application roller 34 from the heat application roller 6 increases, the temperature increase of the pressure application roller 34 becomes faster than the time prior to changing the fusing speed.

On the contrary, the temperature difference at t2 after the constant time has elapsed is detected to be higher than the standard temperature. This indicates that the temperature of the pressure application roller 34 is higher by ΔTb. When the case is applied to the formula 1, the fusing speed of the fuser 4 is decreased. However, as |ΔTa|>|ΔTb|, the decreased amount of the fusing speed is smaller than the point of t1. Therefore, the fusing speed is set at Speed-C, which is the intermediate speed between Speed-A and Speed-B. As a result, the change of the temperature increase of the pressure application roller 34 becomes moderate as shown at the broken line of FIG. 10A, and becomes close to the standard temperature change that is shown by the solid line.

Furthermore, there is no difference (ΔTc) between the detected temperature of the pressure application roller 34 and the standard temperature at t3 after the constant time has elapsed. In this case, the fusing speed of the fuser 4 remains at Speed-C, and is not changed.

This processing is repeated at a constant interval, and the changing process of the fusing speed of the fuser 4 that uses the aforementioned temperature difference ends at the time tn, which is the timing of when the temperature reaches the fusing capable temperature, and processing proceeds to return to Speed-B, which is for printing.

As explained above, in the second embodiment, during warm-up processing when shifting to the image forming operation mode from the waiting mode, because the difference between the temperature of the pressure application roller 34 and the standard temperature increase is repeatedly obtained at a constant interval during warm-up, and the fusing speed is changed, more accurate control without having dispersion of the temperature of the pressure application roller 34 becomes possible compared to the first embodiment.

As described above, in the first and second embodiments, the example of the temperature increase of the pressure application roller 34 when shifting from the waiting mode to the image forming operation mode is explained. However, the present invention can be applied to temperature increase control of the fuser 4 when power is turned on because it can effectively control the temperature increase while maintaining a balance between temperature increase of the pressure application roller 34 and the heat application roller 6.

Moreover, the explanation of the pad 36 and the pressure application belt 32 as structure of the pressure application unit 5 was provided in connection with the first and second embodiments. However, the present invention can be applied to a structure which does not include the pad 36 and the pressure application belt 32. In other words, it can be applied to the structure of the pressure application roller 34 and the temperature sensor 37.

Moreover, in the first and second embodiments, the control of the fusing speed of the fuser 4 was explained. However, it is also possible to control the fuser 4 by stopping and restarting the rotation of the fuser 4.

In the present embodiment, the printer device, especially the fuser of the tandem system printer device is explained. However, it is possible to similarly perform in other types of image forming devices such as a copier.

What is claimed is:

1. An image forming device comprising:

a heater;

a heat application rotation member heated by the heater;

a pressure application rotation member heated by the heat application rotation member;

a detector configured to detect a surface temperature of the pressure application rotation member; and a controller configured to control rotation speed of the heat application rotation member and the pressure application rotation member, wherein after rotation of the heat application rotation member and the pressure application rotation member is started at a first rotation speed during a warm-up period, the controller changes the first rotation speed to a second rotation speed, the second rotation speed depending on an amount of temperature change detected by the detector, and being maintained until the surface temperature of the pressure application rotation member detected by the detector reaches a predetermined temperature, and the amount of temperature change of the surface temperature that is detected by the detector is calculated by the controller based on a temperature increase value that is measured at a predetermined time after the heater begins to heat the heat application rotation member and after the controller begins rotating the heat application rotation member and the pressure application rotation member at the first rotation speed.

2. The image forming device according to claim 1, wherein the controller is further configured to:

set the second rotation speed larger than the first rotation speed when the amount of temperature change of the surface temperature detected by the detector is smaller than a predetermined standard value;

set the second rotation speed to the first rotation speed when the amount of temperature change of the surface temperature detected by the detector equals the predetermined standard value; and set the second rotation speed smaller than the first rotation speed when the amount of temperature change of the surface temperature detected by the detector is greater than the predetermined standard value.

3. The image forming device of claim 1, further comprising a pressure application belt that surrounds the pressure application rotation member and that is configured to rotate with the pressure application rotation member, wherein the heat application rotation member transmits heat to the pressure application rotation member through the pressure application belt.

4. The image forming device according to claim 1, wherein the first rotation speed is a fusion speed at time of fusing a developer on a medium, and the controller changes the second rotation speed to the first rotation speed when the surface temperature reaches the predetermined temperature.

5. A fuser for an image forming device, comprising:

a heat application rotation member; and a pressure application unit including a pressure application rotation member heated by the heat application rotation member, wherein during a warm-up period, the heat application rotation member is configured to rotate at a variable speed to thereby control a surface temperature of the pressure application rotation member to be equal to a predetermined surface temperature value, and the variable speed at which the heat application rotation member is rotated in order to control the surface temperature of the pressure application rotation member is determined according to an initial detection of a temperature change of the surface temperature of the pressure application rotation member after the heat application rotation member and the pressure application rotation member rotate at a standard rotation speed for a predetermined time.

6. The fuser of claim 5, wherein the variable speed of the heat application rotation member is:

increased above the standard rotation speed when the initial detection of the temperature change of the surface temperature is smaller than a predetermined standard value;

set equal to the standard rotation speed when the initial detection of the temperature change of the surface temperature equals the predetermined standard value; and decreased below the standard rotation speed when the initial detection of the temperature change of the surface temperature is greater than the predetermined standard value.

7. The fuser of claim 5, wherein the pressure application unit further comprises a pressure application belt that surrounds the pressure application rotation member and that is configured to rotate with the pressure application rotation member, wherein the heat application rotation member transmits heat to the pressure application rotation member through the pressure application belt.

8. The fuser of claim 7, wherein the pressure application unit further comprises a pad disposed adjacent to the pressure application rotation member, and the pad is configured to apply pressure to the pressure application belt to increase a nip length of the pressure application belt.

* * * * *